US005853174A

United States Patent [19]

McDonald et al.

[11] Patent Number: 5,853,174

[45] Date of Patent: Dec. 29, 1998

[54] GAME AND TWO-WAY RATCHETING MECHANISM

[75] Inventors: Gerald A. McDonald; Ronald G. Magers, both of Gloucester, Mass.

[73] Assignee: M Design, Essex, Mass.

[21] Appl. No.: 881,532

[22] Filed: Jun. 24, 1997

[51] Int. Cl.[6] ..... A63F 7/00

[52] U.S. Cl. ..... 273/447

[58] Field of Search ..... 273/447, 445, 273/446, 118 R, 236

[56] References Cited

U.S. PATENT DOCUMENTS

| | | | |
|---|---|---|---|
| 839,138 | 2/1906 | Hahn . | |
| 2,046,178 | 6/1936 | Musser | 46/127 |
| 2,217,881 | 10/1940 | Allen | 234/1.5 |
| 3,054,218 | 4/1962 | Court | 46/247 |
| 3,169,344 | 2/1965 | Greene | 46/132 |
| 3,559,334 | 2/1971 | Beny et al. | 46/206 |
| 3,698,130 | 10/1972 | Usami | 46/206 |
| 3,721,036 | 3/1973 | Goldfarb | 46/43 |
| 3,861,684 | 1/1975 | Gastin et al. | 273/134 G |
| 4,010,956 | 3/1977 | Zyla et al. | 273/134 CA |
| 4,021,962 | 5/1977 | Axryd | 46/202 |
| 4,089,529 | 5/1978 | Usami | 273/282 |
| 4,257,610 | 3/1981 | Ptaszek et al. | 273/248 |
| 4,285,159 | 8/1981 | Bass et al. | 46/262 |
| 4,324,405 | 4/1982 | Kruger, Jr. et al. | 273/238 |
| 4,449,321 | 5/1984 | Reiling | 46/113 |
| 4,664,640 | 5/1987 | Shindo et al. | 446/227 |
| 4,728,312 | 3/1988 | Ohnuma | 446/314 |
| 4,799,916 | 1/1989 | McKay et al. | 446/444 |
| 4,813,670 | 3/1989 | Mizunuma | 273/447 |
| 4,900,026 | 2/1990 | Kulesza et al. | 273/447 X |
| 5,342,064 | 8/1994 | Williamson et al. | 273/447 |
| 5,594,976 | 1/1997 | Shkolnik et al. | 16/380 |
| 5,702,108 | 12/1997 | Todokoro | 273/447 |

FOREIGN PATENT DOCUMENTS 806957 2/1981 U.S.S.R. .

*Primary Examiner*—William E. Stoll

*Attorney, Agent, or Firm*—Marshall, O'Toole, Gerstein, Murray & Borun

[57] ABSTRACT

A two-way ratchet mechanism operated by a plunger that moves a pawl housing in one of two directions. The ratchet mechanisms are preferably used in a children's game to simultaneously gather game pieces in receptacles.

19 Claims, 14 Drawing Sheets

GAME AND TWO-WAY RATCHETING MECHANISM

FIELD AND BACKGROUND OF THE INVENTION

This invention relates to a children's game having a number of two-way ratcheting mechanisms operated by players to move game pieces from a retention area through a retention gate and into a receptacle so that the first player to move a predetermined number of game pieces to his or her respective goal is the winner.

Ratcheting mechanisms in toys and games are known, for example, in Axryd, U.S. Pat. No. 4,021,962, which discloses a track and an article movable along a predetermined path capable of reciprocable movement by means of a driving means provided with longitudinally interspaced projections to engage carrier pins on the movable article to be propelled. The reciprocating movement results from the movement of a operating bar either manually or by a driving motor. There is no provision in Axryd for a remote plunger mechanism to move an object along a raceway in competition with another player, nor are there any game pieces to be collected by individual players by the movable article to determine a winner of a game.

Hahn, U.S. Pat. No. 839,138, discloses a racing game using a number of ratcheting mechanisms to move game pieces along individual tracks to a goal. However, there is no disclosure in Hahn of any remote plunger assembly for use in moving a mechanism along a race way to collect game pieces or a ratcheting mechanism that causes movement in two directions.

Therefore, it is desirable to have a game and apparatus including a number of ratcheting mechanisms operated by remote plungers to move a mechanism in two directions along raceways to collect game pieces in competition with other players to determine a winner.

SUMMARY OF THE INVENTION

The present invention is directed to a game having a frame, a retaining area such as a bowl formed in the frame, a pair of tracks formed in the frame, each of the tracks extending into the retaining area, a first receptacle associated with one of the tracks, a second receptacle associated with another of the tracks, at least three game pieces adapted to be disposed within the retaining area and movable along the tracks. The game also includes a pair of movable members, each being adapted to move along a respective one of the tracks, and a pair of ratcheting mechanisms each of which is operatively coupled to a respective one of the movable members. The ratcheting mechanisms are adapted to cause the movable members to be moved along the tracks in a first direction, to automatically change from the first direction to a second direction along the tracks, and then to automatically change back to the first direction along the tracks.

The game also includes a pair of actuators, each of which is operatively coupled to a respective one of the ratcheting mechanisms so that actuation of the actuators causes the ratcheting mechanisms to move the movable members along the tracks and so that repeated actuation of one of the actuators is adapted to cause one of the movable members to enter the retaining area to engage one of the game pieces in the retaining area, to push the one game piece along one of the tracks and out of the retaining area until the one game piece is deposited in one of the receptacles, and to automatically change direction so that the one movable member reenters the retaining area to engage another of the game pieces.

Each of the movable members may have a housing with a shape in the form of an animal, such as a puppy. Each of the actuators may comprise a knob that is adapted to be repeatedly depressed and a plunger assembly operatively coupled to the knob and the ratcheting mechanism. The game may also include a first movable gate associated with one of the tracks and a second movable gate associated with another of the tracks, each of the movable gates being adapted to allow the movable member to pass through.

Apparatus in accordance with this invention may include: a frame; a ratchet track slidably joined to the frame; a pawl housing slidably joined to the frame; a first pawl pivotably joined to the pawl housing; a second pawl pivotably joined to the pawl housing; a mechanism for selectively engaging either the first pawl or the second pawl with the ratchet track; and a mechanism for reciprocating the ratchet track to slide the pawl housing in a first direction when the first pawl engages the ratchet track and in a second direction when the second pawl engages the ratchet track.

The mechanism for selectively engaging pawls may include: a counterweight pivotably joined to the pawl housing and to the first pawl and the second pawl; and a mechanism for pivoting the counterweight between a first position and a second position. The mechanism for pivoting the counterweight preferably includes: a first ramped frame portion whereon the counterweight is pivoted from the first position to the second position; and a second ramped frame portion whereon the counterweight is pivoted from the second position to the first position.

The mechanism for reciprocating the ratchet track may include: a plunger joined to the frame for movement between a first position and a second position; a tab fixed to the plunger; and a ramp fixed in relation to the ratchet track and defining a slip surface with the tab that reciprocates the ratchet track as the plunger moves between the first position and the second position. Alternatively, the mechanism for reciprocating the ratchet track may include: a plunger joined to the frame for movement between a first position and a second position; a gear rack fixed to the plunger; a first gear rotatably mounted on the frame and meshed with the gear rack; a second gear fixed to the first gear; and a short rack meshed with the second gear and fixed in relation to the ratchet track, the short rack for reciprocating in response to the plunger moving between the first position and the second position.

The apparatus may also include: a second ratchet track slidably joined to the frame; a second pawl housing slidably joined to the frame; a third pawl pivotably joined to the second pawl housing; a fourth pawl pivotably joined to the second pawl housing; a mechanism for selectively engaging either the third pawl or the fourth pawl with the second ratchet track; and a mechanism for reciprocating the second ratchet track to slide the second pawl housing in a first direction when the third pawl engages the second ratchet track and in a second direction when the fourth pawl engages the second ratchet track.

Preferably, the apparatus includes game pieces positioned on the frame for being relocated in response to the pawl housing sliding relative to the frame. The game pieces can be directed into recesses to decide a game winner. A gate can traverse the ratchet track to add a level of difficulty and improve play value.

Also in accordance with the present invention is a game having an apparatus including: a frame; a plurality of ratchet assemblies, wherein each ratchet assembly includes; a ratchet track slidably joined to the frame, a pawl housing slidably joined to the frame, a first pawl pivotably connected to the pawl housing, a second pawl pivotably connected to the pawl housing, a mechanism for selectively engaging either the first pawl or the second pawl with the ratchet track, and a mechanism for reciprocating the ratchet track to slide the pawl housing in a first direction in response to the first pawl engaging the ratchet track and in a second direction in response to the second pawl engaging the ratchet track; and a number of game pieces disposed on the frame for being relocated in response to the pawl housings sliding relative to the frame; whereby game instructions direct a plurality of players to select a ratchet assembly and to simultaneously operate their respective ratchet assembly to move game pieces to a frame receptacle.

DETAILED DESCRIPTION OF THE DRAWINGS

Figure 1:
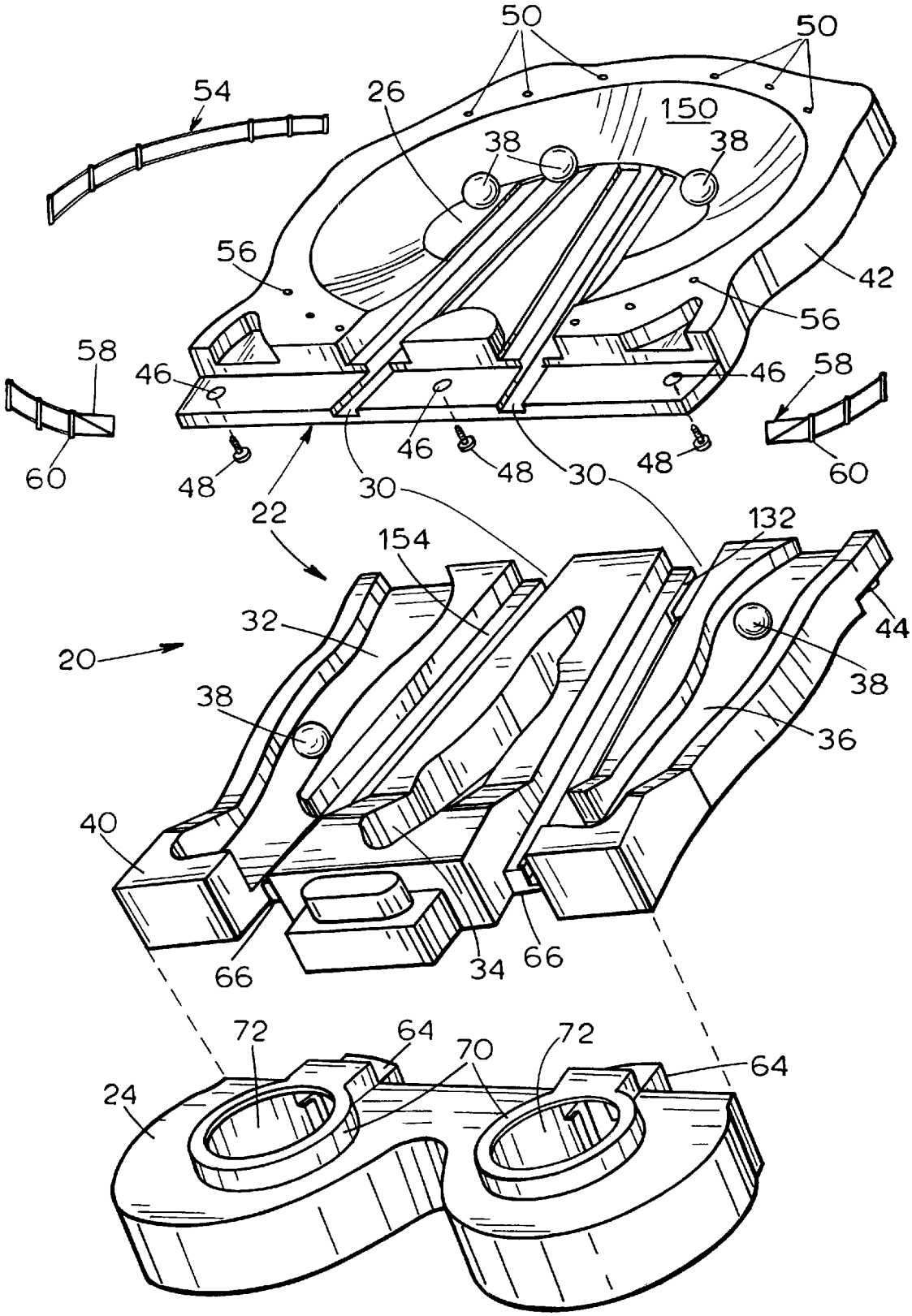
FIG. 1 is an exploded perspective view of a game frame and related components in accordance with the present invention.

To the extent practical, the same reference numerals will be used to identify the same or similar items in each of the figures. Illustrated in FIG. 1 is a game 20 in accordance with the present invention. The game 20 includes a frame 22 having a pedal cover 24 (bottom), and a bowl 26 (top).

The frame 22 is preferably in the form of a stylized yard in which there are a pair of tracks 30, a first receptacle 32, a second receptacle 34, and a third receptacle 36. Preferably, the frame 22 is formed of plastic in two parts, one being a race track portion 40 and the other being the track bowl portion 42. The race track portion 40 is joined to the track bowl portion 42 by three downwardly extending pins 44 on the race track portion 40 inserted into three matching holes 46 in the track bowl portion 42. Screws 48 extend upwardly through the holes 46 and are threaded into pins 44 to secure the race track portion 40 to the track bowl portion 42. The track bowl portion 42 includes the bowl 26 and a plurality of recesses 50 for receiving downwardly extending pins from a fence 54. Additional recesses 56 are provided to receive pins from a pair of gates 58.

Each of the gates 58 are pivotably connected to the track bowl portion 42 by a drop hinge that maintains the gates 58 in the closed position as illustrated in FIG. 1. The gates 58 can be opened during game play by applying a force to the gates 58 to overcome resistance of the drop hinge 60. When the force on the gate 58 is released, the drop hinge 60 causes the gate 58 to close automatically. The drop hinge 60 is constructed in a conventional manner with ramped surfaces for directing the gate 58 to a closed position, as will be recognized by those skilled in the art.

The frame 22 includes the pedal cover 24 which preferably includes male snap elements 64 that engage mating female snap elements 66 in the race track portion 40. The snap engagement between the pedal cover 24 and the race track portion 40 permits the game 20 to be shipped in a smaller box and assembled easily by a user.

Figure 2:
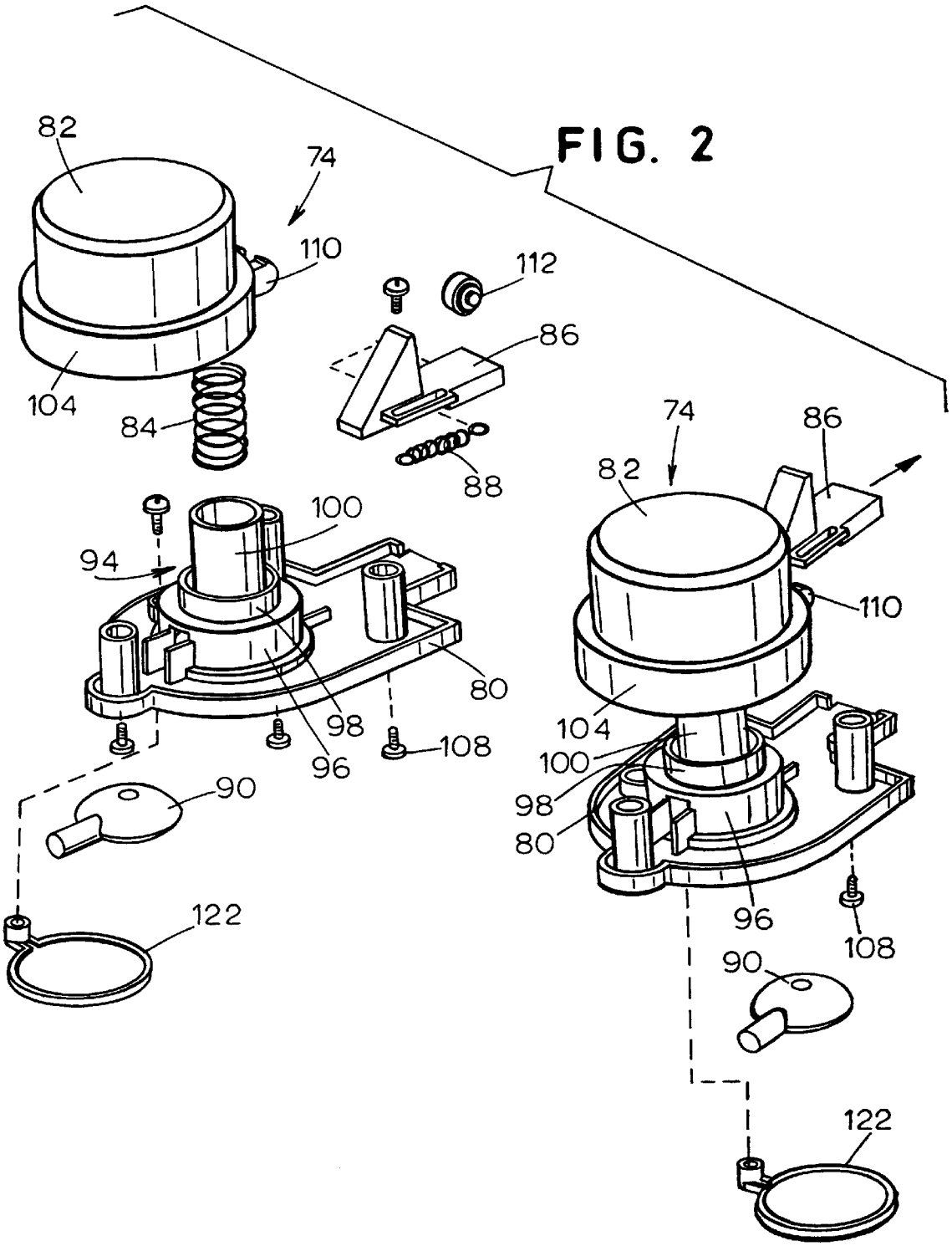
FIG. 2 is an exploded perspective view of a pair of plunger assemblies in accordance with the present invention.

The pedal cover 24 also includes a pair of collars 70 surrounding a pair of holes 72 in which a pair of plunger assemblies 74 (FIGS. 2, 3, and 4) are located. Each of the plunger assemblies 74 are substantially identical and, thus the description of only one of the pair will be provided. Each plunger assembly 74 includes a pedal base 80, a knob 82, a knob compression spring 84, a plunger 86, a plunger tension spring 88, and, preferably a sound mechanism 90.

The pedal base 80 includes a central pedestal 94 having a lower base portion 96, a central sleeve portion 98, and an upper cylindrical portion 100. The knob compression spring 84 is preferably sized to be disposed over the upper cylindrical portion 100 and within the central sleeve portion 98 to confine possible lateral movement of the knob compression spring 84. The knob 82 is then disposed over the pedestal 94 and the knob compression spring 84 such that the knob 82 is maintained in a normally upper first position by the knob compression spring 84.

Figure 3:
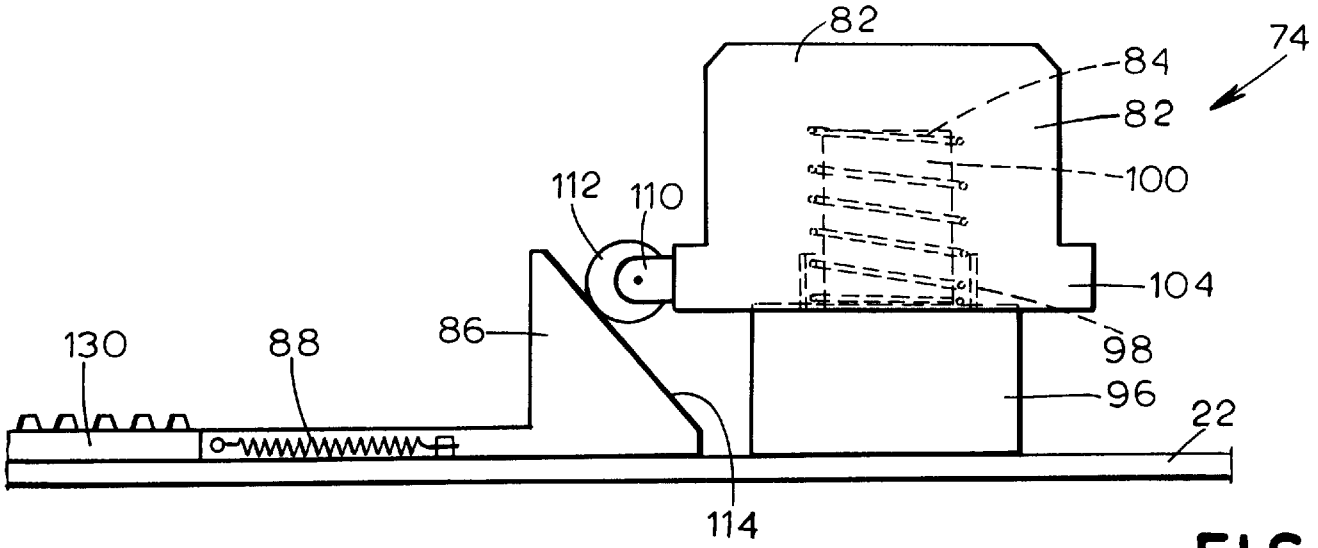
FIG. 3 is a side cross-sectional view of a plunger assembly and a portion of a reciprocating ratchet track.
Figure 4:
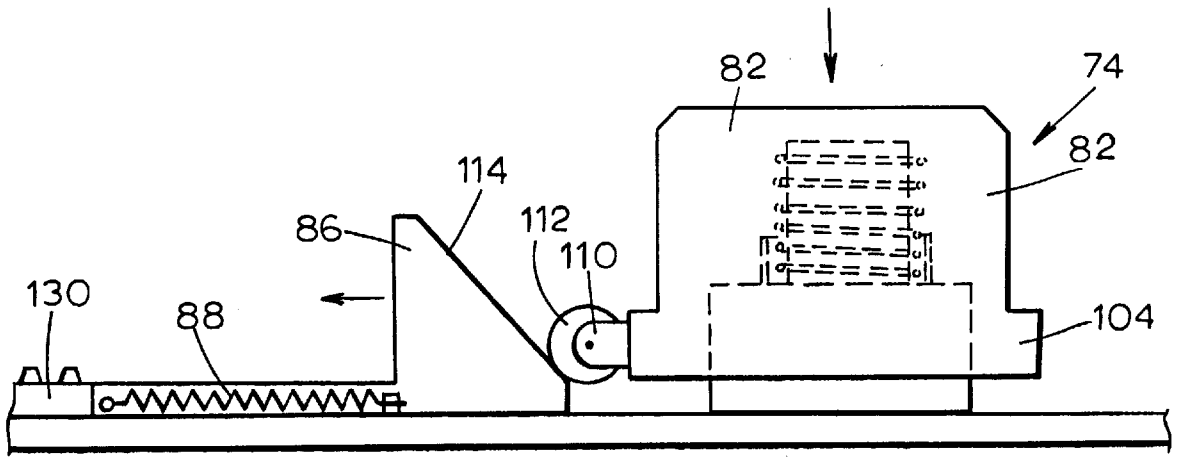
FIG. 4 is a second side elevational view of the plunger assembly and ratchet track of FIG. 3.
Figure 5:
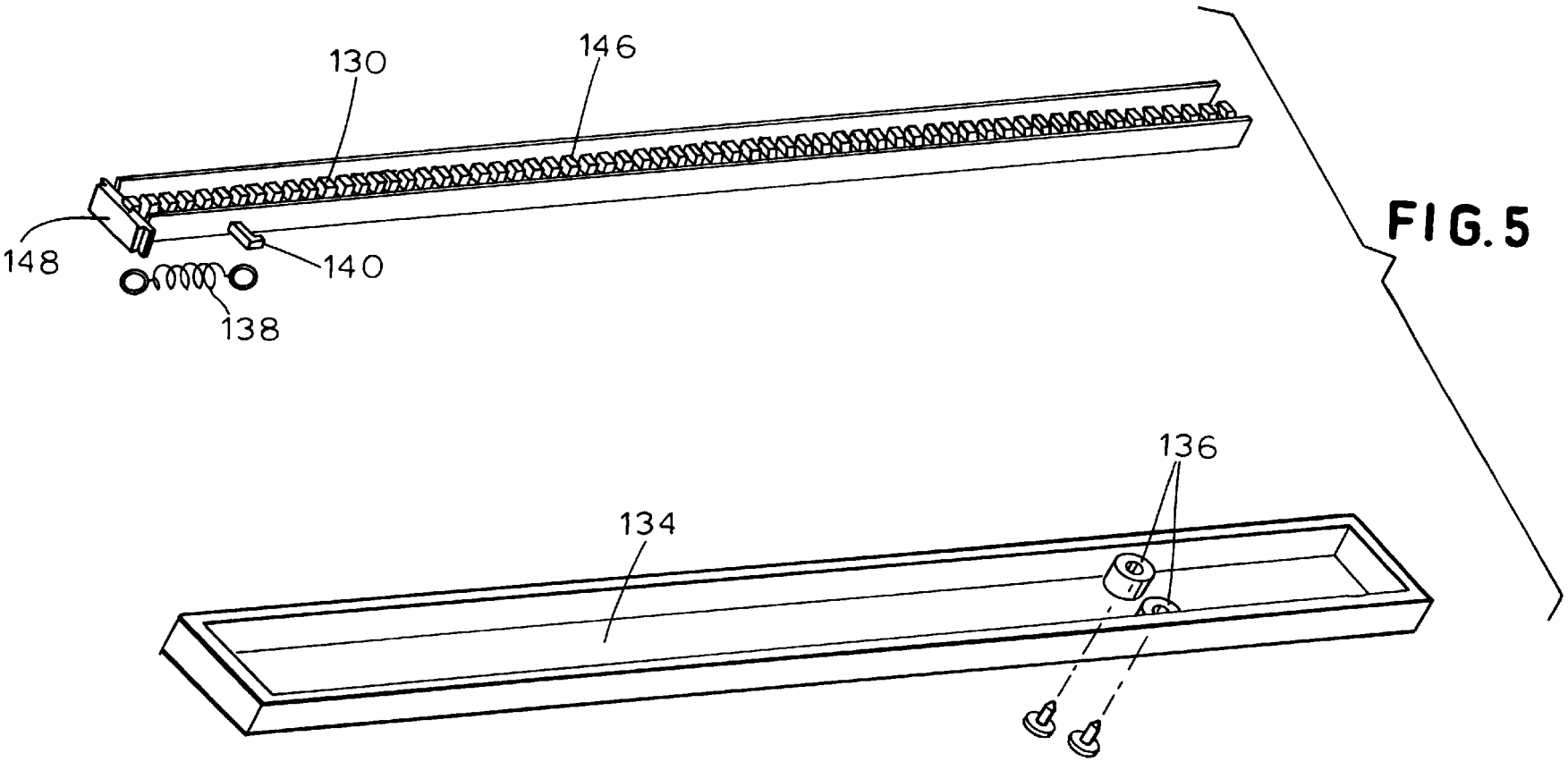
FIG. 5 is an exploded perspective view of a reciprocating ratchet track in accordance with the present invention.
Figure 6:
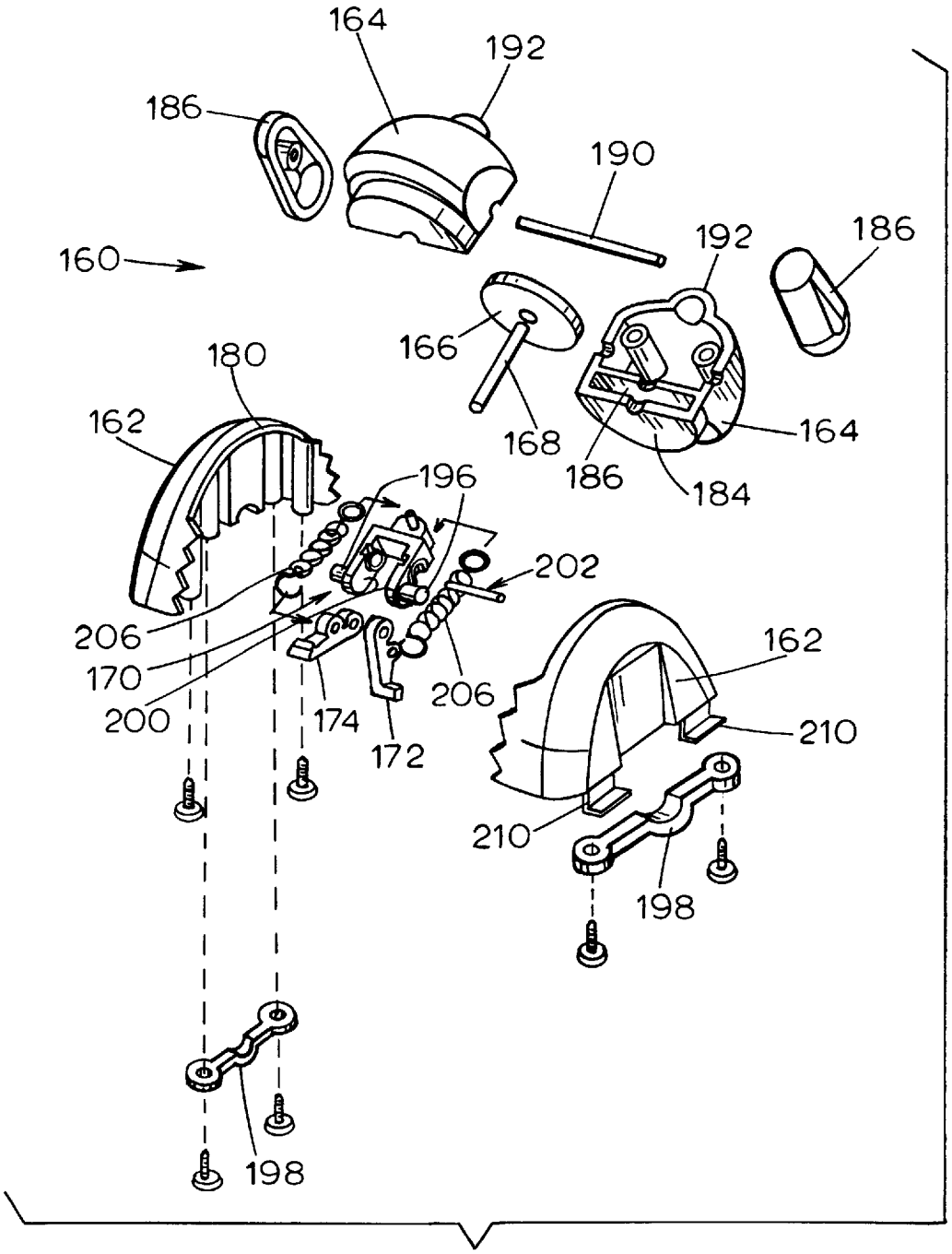
FIG. 6 is an exploded perspective view of a mechanism for traveling on a ratchet track in accordance with the present invention.

The knob 82 includes a lower rim portion 104 that is slightly larger than the collar 70 on the pedal cover 24. In this manner, the knob 82 can be inserted up into the pedal cover 24, through the hole 72, and abut the collar 70 to be prevented from being pulled upwardly and off of the pedal base 80. The pedal base 80 itself can then be secured to the frame 22 using screws 108 to the pedal cover 24 so that the knob 82 is permitted to travel downwardly in opposition of the knob compression spring 84 until the knob 82 bottoms out on the upper cylindrical portion 100 of the pedestal 94 in a second bottom position (FIG. 4). When released, the knob 82 will return to its first upper position and be retained there by the collar 70 on the pedal cover 24 (FIG. 3).

The knob 82 also includes a forwardly extending rounded tab 110 with a roller 112 (FIGS. 3 and 4) that engages the plunger 86. The plunger 86 includes a rearwardly ramped portion 114 for being engaged by the roller 112 of the knob 82. When the knob 82 is in its first top position, the roller 112 is arranged to engage the ramped portion 114 of the plunger 86 near the top of the ramped portion 114 as illustrated in FIG. 3. When the knob 82 is pushed downward to its second bottom position, the roller 112 slides down the ramped portion 114 to force the plunger 86 away from the knob 82 as illustrated in FIG. 4.

The plunger 86 is confined between the pedal cover 24 and the pedal base 80. The plunger tension spring 88 extends between the plunger 86 and the pedal base 80 and is tensioned as the plunger 86 moves outward from the knob 82 so that when the knob 82 is released, the plunger 86 will return to its original position adjacent the knob 82 as illustrated in FIG. 3.

With this arrangement of elements, each plunger assembly 74 is operated by pressing downwardly on the knob 82 to force the plunger 86 outwardly from the pedal cover 24. To return the plunger 86 to its original position the knob 82 is simply released to permit the plunger tension spring 88 to pull the plunger 86 back. With an appropriately sized knob compression spring 84 this action can be repeated many times in a very quick manner by players using the game 20. To enhance the play value of the game 20, the sound mechanism 90 may include squeakers that are activated each time the knobs 82 are pushed downward. The squeakers 90, can be maintained in place by squeaker covers 122 (FIG. 2) or in any other suitable location to be squeezed when the knobs 82 make sufficient compression.

The plunger 86 of the plunger assembly 84 mates at its fore end with a reciprocating ratchet track 130. The ratchet track 130 is disposed in the tracks 30 of the frame 22 for sliding movement between a rear first position and a forward second position. The ratchet track 130 can be retained in the frame 22 using opposing flanges 132 (FIG. 1) in the frame 22 disposed over the ratchet track 130. It may be desirable to use a rack cover 134 in the bottom of the frame 22 to loosely confine the ratchet track 130 in the frame 22. Further, a pair of rollers 136 may be positioned under the ratchet track 130 and above the rack cover 134 to enhance the reciprocating movement of the ratchet track 130. The ratchet track 130 is maintained in the rearward first position by a rack tension spring 138 which extends between a spring arm 140 on the ratchet track 130 and a fixed spring post (not illustrated) on the frame 22.

Positioned along the top of the ratchet track 130 are a series of equally spaced and upwardly extending cogs 146. At the rear end of the ratchet track 130 is a butt plate 148 that is in constant engagement with the plunger 86 because the rack tension spring 138 biases the ratchet track 130 rearward and the ratchet track 130 will move forward only when the knob 82 is pushed downward to force the plunger 86 forward into engagement with the butt plate 148 of the ratchet track 130. Preferably, the ratchet track 130 extends across both the race track portion 40 and the track bowl portion 42 of the frame 22. The forward end of the ratchet track 130 terminates at an upwardly curved portion 150 of the bowl 26, as illustrated.

The cogs 146 of the ratchet track 130 extend upward through or are otherwise exposed through a longitudinal slot 154 in the frame 22. A mechanism for being moved along the tracks 30 is illustrated generally as item 160 in FIGS. 6 to 11. The mechanism 160 includes a pawl housing 162, a counterweight housing 164, a counterweight 166, a yoke shaft 168, a yoke 170, a first pawl 172, and a second pawl 174.

The pawl housing 162 can be any shape or size, but is preferably in the form of a stylized puppy in accordance with the theme of the game 20. The pawl housing 162 is preferably made in two halves and defines an arcuate slot 180 opened upwardly.

Slideably disposed in the arcuate slot 180 of the pawl housing 162, is the counterweight housing 164 which itself is preferably made in two halves and is slidably restrained within the arcuate slot 180 by a collar 184. Inside the counterweight housing 164 is a chamber 186 for holding the counterweight 168. Also, as part of the counterweight housing 164 there is a pair of ears 186 pivotably connected to the counterweight housing 164 by an ear shaft 190. The ears 188 are preferably pivotable by the ear shaft 190 so that they extend generally downward regardless of the orientation of the counterweight housing 164. Extending forwardly and slightly upwardly from the counterweight housing 164 is a protrusion 192 that is preferably in the form of a nose to conform to the puppy theme of the present game 20.

Figure 7:
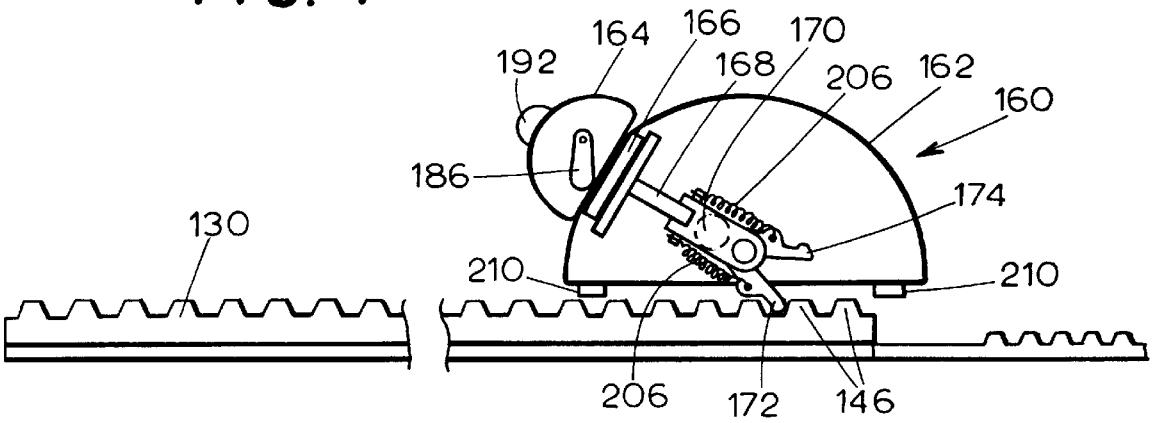
FIG. 7 is a side cross-sectional view of a mechanism and a ratchet track in accordance with the present invention.
Figure 8:
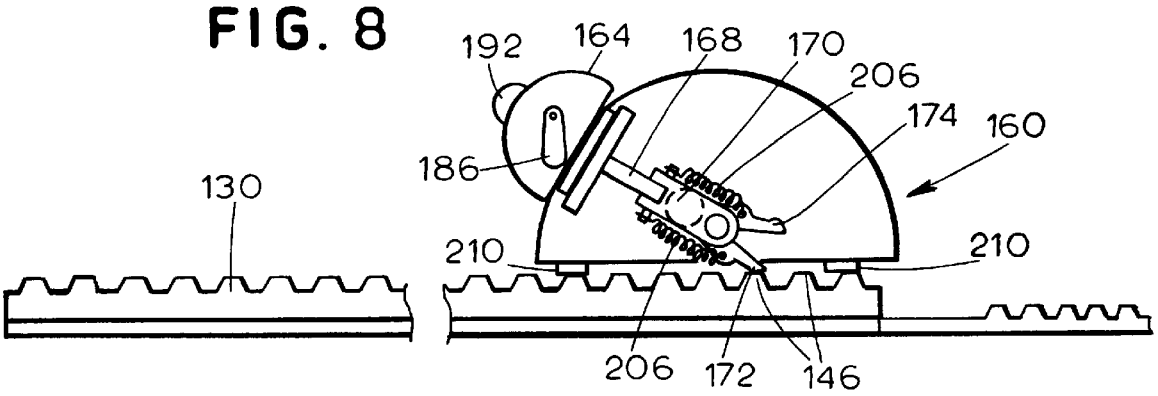
FIG. 8 is the mechanism and ratchet track of FIG. 7 in a second position.
Figure 9:
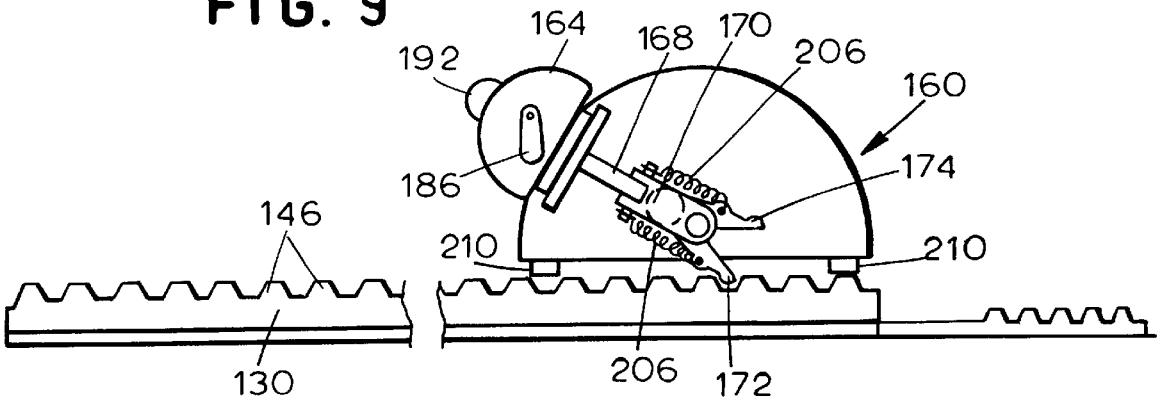
FIG. 9 is the mechanism and ratchet track of FIG. 7 in a third position.
Figure 10:
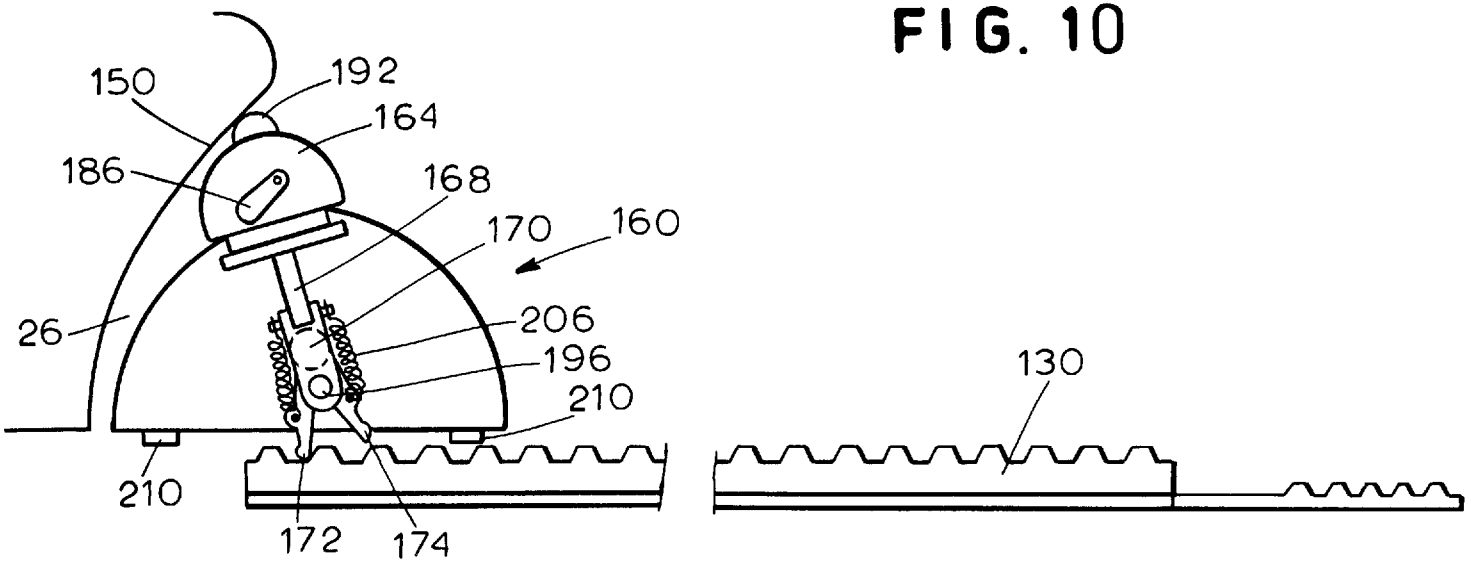
FIG. 10 is the mechanism and ratchet track of FIG. 7 in a fourth position.
Figure 11:
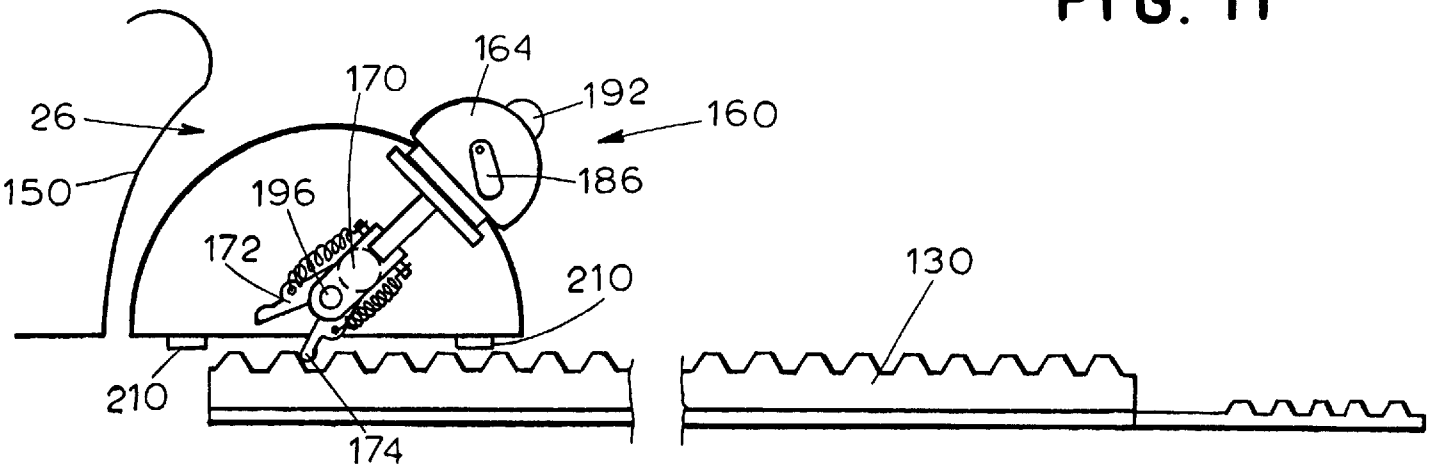
FIG. 11 is the mechanism and ratchet track of FIG. 7 in a fifth position.

The counterweight 166 is connected to the yoke shaft 168 which extends downwardly into the pawl housing 162 and into the yoke 170. The yoke 170 is pivotably joined to the pawl housing 162 by pins 196 that are retained by yoke clamps 198. When the counterweight housing 164 is leaning forward, the yoke 170 extends rearwardly within the pawl housing 162 as illustrated in FIGS. 7 to 9. When the counterweight housing 164 leans rearwardly, the yoke 170 extends forwardly within the pawl housing 162 FIG. 11.

The yoke 170 includes a pair of yoke arms 200 spaced apart to receive the first pawl 172 and the second pawl 174. The first pawl 172 and the second pawl 174 are retained between the yoke arms 200 by a pawl shaft 202 that extends through holes in the yoke arms 200 and in the pawls 172 and 174. The pawls are biased toward a splayed position by pawl springs 206. The pawls 172 and 174 have lower ends adapted to engage the cogs 146 of the ratchet track 130. The pawl housing 162 is slidably joined to the frame 22 by opposing flanges 210. As illustrated in FIGS. 7 to 11, when the pawl housing 162 is joined to the frame 22 either the first pawl 172 or the second pawl 174, but not both, will be in engagement with the ratchet track 130.

As the ratchet track 130 reciprocates back and fourth in response to the knob 82 being operated by a game player, the cogs 146 serially engage the first pawl 172 to push the pawl housing 162 in the direction of movement of the ratchet track 130. When the ratchet track 130 returns to its original position as a result of the urging by the rack tension spring 138, the cogs 146 are unable to forcibly engage the first pawl 172 due to their respective shapes. Consequently, the first pawl 172 will slide over the top of a cog 146 against the bias of the pawl spring 206. Once the cog 146 has moved clear, the pawl spring 206 will return the first pawl 172 to its normal position where it can be engaged by the next cog 146 as the ratchet track 130 moves forward again. In this manner, as the knob 82 is pushed down and released, the mechanism 160 will be ratcheted along a track 30 toward the bowl 26. Along the way, the pawl housing 162 will force through a gate 58 and into the bowl 26 where game pieces are located.

Once the mechanism 160 reaches the end or near the end of the ratchet track 130, the counterweight housing 164 or its protrusion 192 will engage an upwardly curved portion 150 of the bowl 26 to cause the counterweight housing 164 to pivot through the arcuate slot 180 and flip over to face the opposite direction. When this occurs, the first pawl 172 will disengage the ratchet track 130 and the second pawl 174 will become engaged with the ratchet track 130. The pawl housing 162 will then travel back toward its original position as a result of the knob 82 being operated by a game player. It is noted that this ratcheting movement is the opposite of the action described above. Now, when the knob 82 is depressed and the ratchet track 130 is forced outwardly from the plunger assembly 74, the second pawl 174 will ride over the top of a cog 146 in the ratchet track 130. When the knob 82 is released, the cog 146 of the ratchet track 130 will move back to its original position as a result of the rack tension spring 138 and engage the second pawl 174 to urge the mechanism 160 back along the track 30 toward the plunger assembly 74.

As the pawl housing 162 moves back along the track 30, the pawl housing 162 or the counterweight housing 164 will engage a game piece 38 and push it in the direction the pawl housing 162 is moving. The pawl housing 162 will push a game piece 38 through the gate 58 as it proceeds, and the game piece 38 will move toward one of the receptacles 32, 34, or 36. If the game piece 38 lands in the first receptacle 32 it becomes the possession of the player on the left side of the game 20. If the game piece lands in the second receptacle 34, it belongs to no player and can be returned to the bowl 26. If the game piece 38 lands in the third receptacle 36, it belongs to the player on the right side of the game 20. The frame 22 can be shaped to limit which receptacle a game piece 38 may roll into. For example, the frame 22 shape may be such that a game piece 38 can only fall into the center receptacle 34 or in a receptacle closest to the player that forced the game piece 38 through a gate 58.

When the pawl housing 162 reaches its rearward most position, the counterweight housing 164 or the protrusion 192 will engage another upwardly extending curved portion 218 and flip over to reengage the first pawl 172 with the ratchet track 130 for a return trip to the bowl 26 and an attempt to capture another game piece 38 in that respective player's receptacle. This process can be repeated as many times as desired by the players but instructions for the game preferably call for winner to be the player who first has three game pieces 38 in his or her receptacle.

Figure 12:
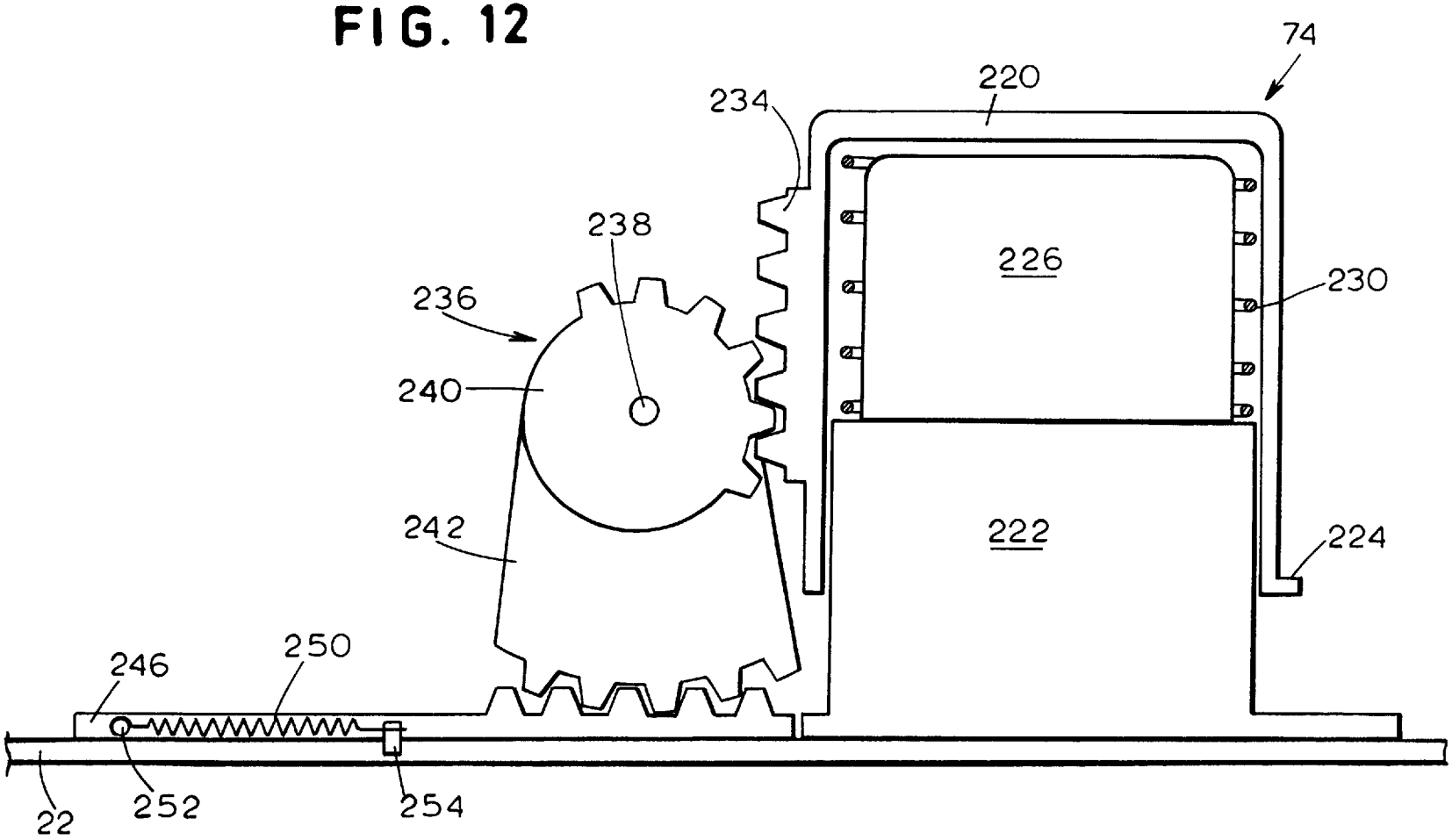
FIG. 12 is a side cross-sectional view of an alternative plunger assembly in accordance with the present invention.
Figure 13:
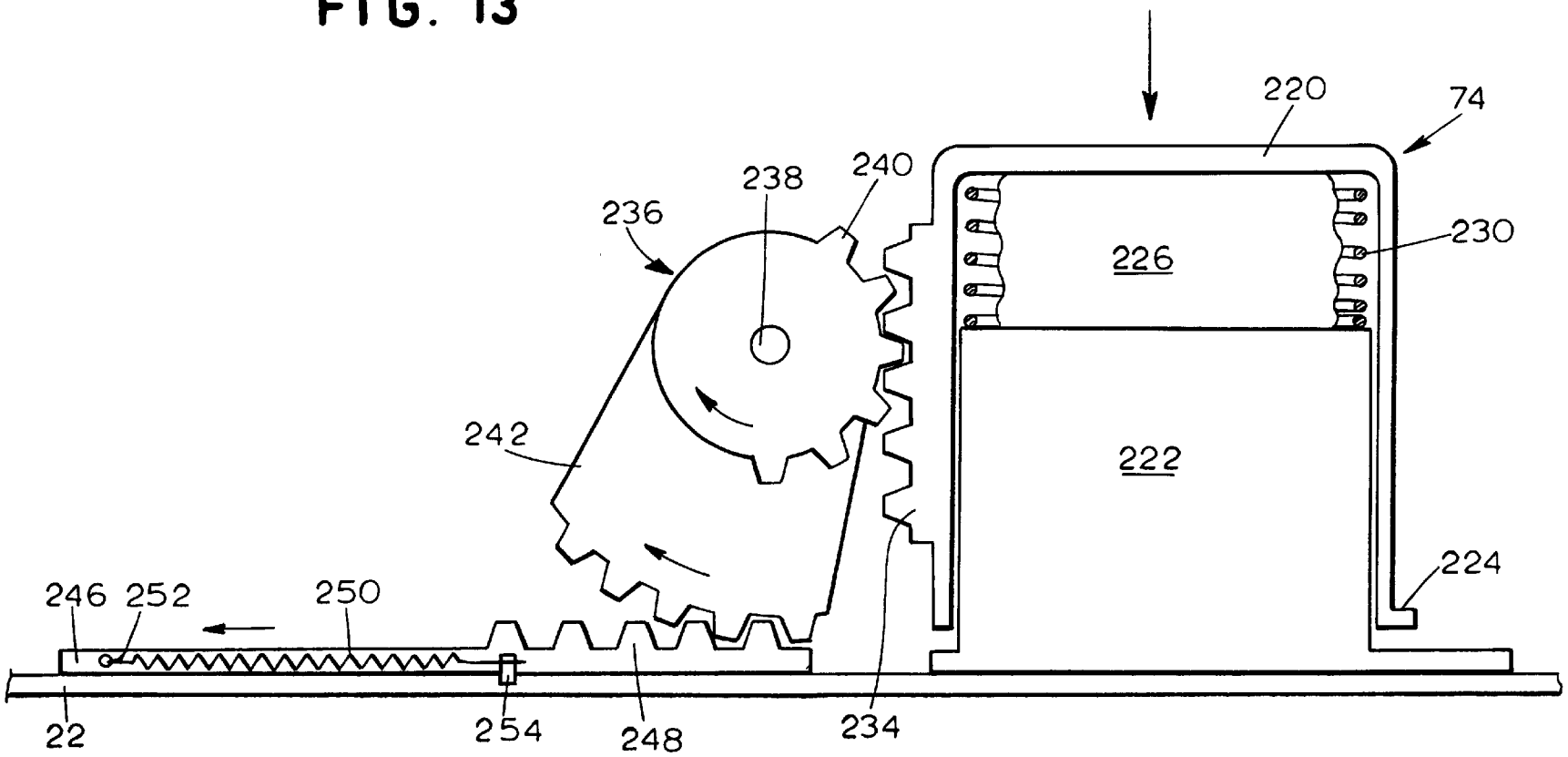
FIG. 13 is the plunger assembly of FIG. 12 in a second position.

An alternative embodiment for a plunger assembly 74 is illustrated in FIGS. 12 and 13. The plunger assembly 74 includes a knob 220 disposed over an elevated platform 222 of a slightly smaller diameter then an inside opening of the knob 220. The knob 220 also includes an outwardly extending flange 224 that acts to retain the knob 220 inside of a pedal cover (not illustrated). On top of the elevated platform 222 there is a noise maker 226 around which a compression spring 230 is disposed.

On the left side of the knob 220 there is a short vertical rack 234. Adjacent the rack 234 is a gear mechanism 236 that is rotatably joined on an axis 238 joined to the track frame 22. The gear mechanism 236 includes a first sector gear 240 meshed with the rack 234. The first sector gear 240 is fixed in relation to a second sector gear 242, as illustrated. The second sector gear 242 extends downwardly from the axis 238 and is meshed with cogs 248 on a plunger 246 that is slidably engaged to the frame 22. The sliding plunger 246 is in a normal rearward and first position as illustrated in FIG. 12 due to the bias of a sliding plunger spring 250 that is hooked to a pin 252 on the sliding plunger 246 and to a post 254 on the frame 22. With this arrangement, the knob 220 will be in a normally upward first position as illustrated in FIG. 12 with the gears and plunger 246 arranged as illustrated. When the knob 220 is pushed downward, the compression spring 230 is compressed, the rack 234 moves downward, the gear mechanism 236 rotates clockwise, and the sliding plunger 246 moves outward from the knob 220 to the left (as illustrated in FIG. 13). This mechanism is similar to the plunger assembly 74 described above in its function and result, but it accomplishes those functions and results in a slightly different manner.

Figure 14:
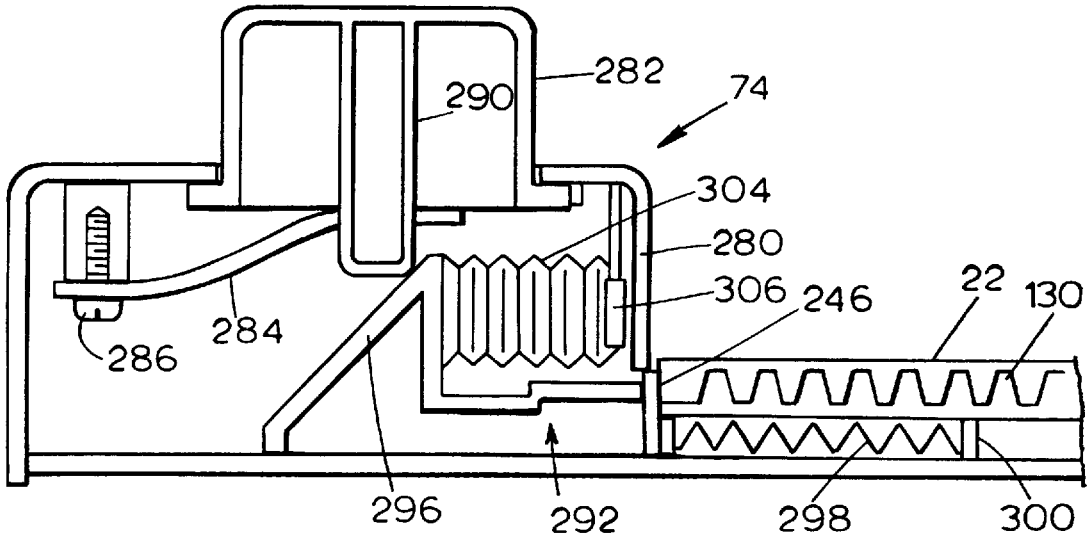
FIG. 14 is a side elevational view of a second alternative plunger assembly in accordance with the present invention.
Figure 15:
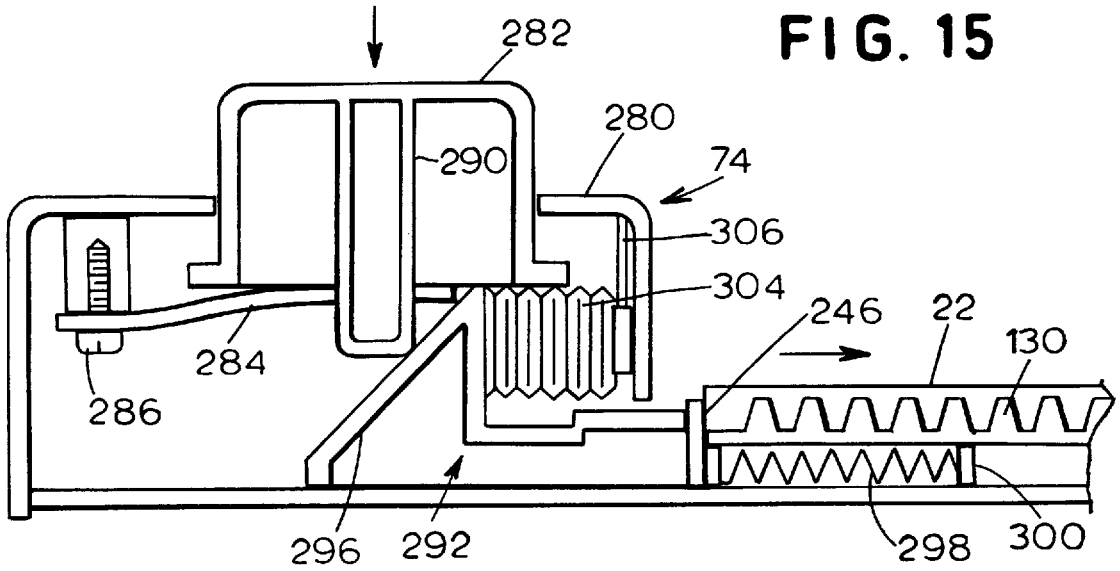
FIG. 15 is the plunger assembly of FIG. 14 in a second position.
Figure 16:
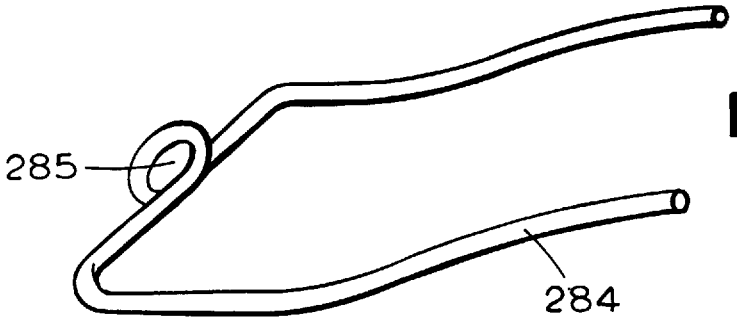
FIG. 16 is a perspective view a knob spring for use in the plunger assembly of FIGS. 14 and 15.

Another embodiment of a plunger assembly 74 is illustrated in FIGS. 14 and 15. This plunger assembly 74 includes a pedal cover 280 mounted on the frame 22. The pedal cover 280 includes a top opening through which a knob 282 extends upwardly due to the biasing from a spring 284. The spring 284 is best illustrated in FIG. 16 as being a resilient wire roughly having a u-shape and with a loop 285 therein to accommodate a screw 286 to mount the spring 284 to the pedal cover 280 as illustrated in FIGS. 14 and 15.

The knob 282 includes a downwardly extending rod 290 that bears on a ramped plunger 292. The plunger 292 has a ramped portion 296 directly beneath the knob rod 290. The plunger 292 is slideably disposed inside of the pedal cover 280 for lateral movement from a first position (FIG. 14) to a second position (FIG. 15). The plunger 292 bears on the sliding plunger 246 ramped portion 296, as illustrated. The plunger 292 is biased toward the first position (FIG. 14) by a compression spring 298. The compression spring 298 is disposed between a fixed post 300 on the frame 22 and the right end of the plunger 292, as illustrated. Positioned behind the plunger 292 ramped portion 296 is a bellows squeaker 304 that is sandwiched between the backside of the ramped portion 296 and a downwardly extending tab 306 fixed in relation to the pedal cover 280.

With the above described plunger assembly 74, it should be readily apparent that pressing downward on the knob 282, compresses the spring 284, shifts the plunger 292 to the right, compresses the bellows squeaker 304, and urges the sliding plunger 246 to the right. Releasing the knob 282 permits the compression spring 298 to return the sliding plunger 246 to its first position and the spring 284 to urge the knob 282 upward to for repeated operation.

An alternative embodiment of a ratcheted mechanism 310 is illustrated in FIGS. 17 through 20. As illustrated, the ratcheting mechanism 310 is in the form of a puppy in keeping with the theme of the game 20. The ratcheting mechanism 310 includes a pawl housing 312, a counterweight housing 314, a yoke shaft 318, a yoke 320, a first pawl, and a second pawl. The pawl housing 312 preferably includes a rounded upper surface having an upwardly open arcuate slot 328 and is open in its bottom end. Extending through the arcuate slot 328 is the yoke shaft 318 that connects the counterweight housing 314 to the internal mechanism described below. The counterweight housing 314 preferably includes or is integral with a counterweight so that the counterweight housing 314 tends to pivot downwardly. The counterweight housing 314 is again in the form of a stylized puppy head with pivoting ears 188 and a nose or protrusion 192.

Figure 19:
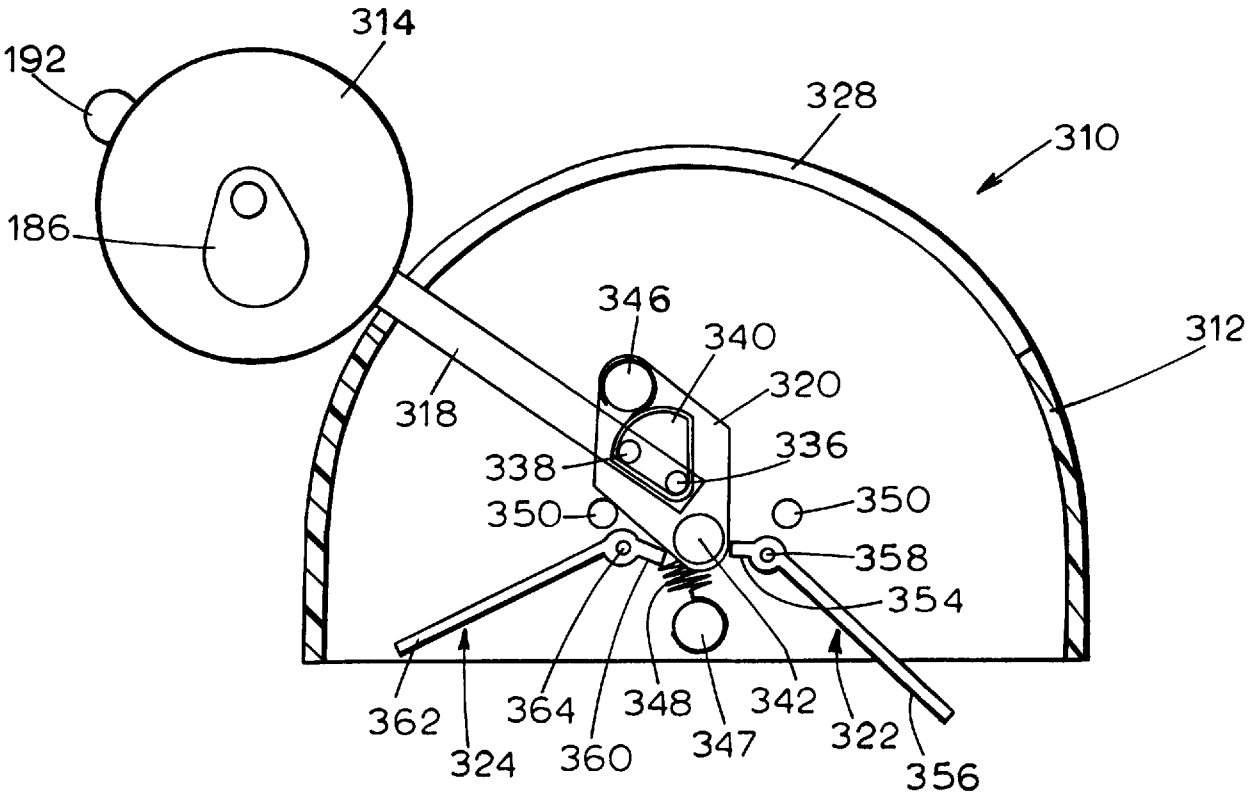
FIG. 19 is the mechanism of FIG. 17 in a third position.
Figure 20:
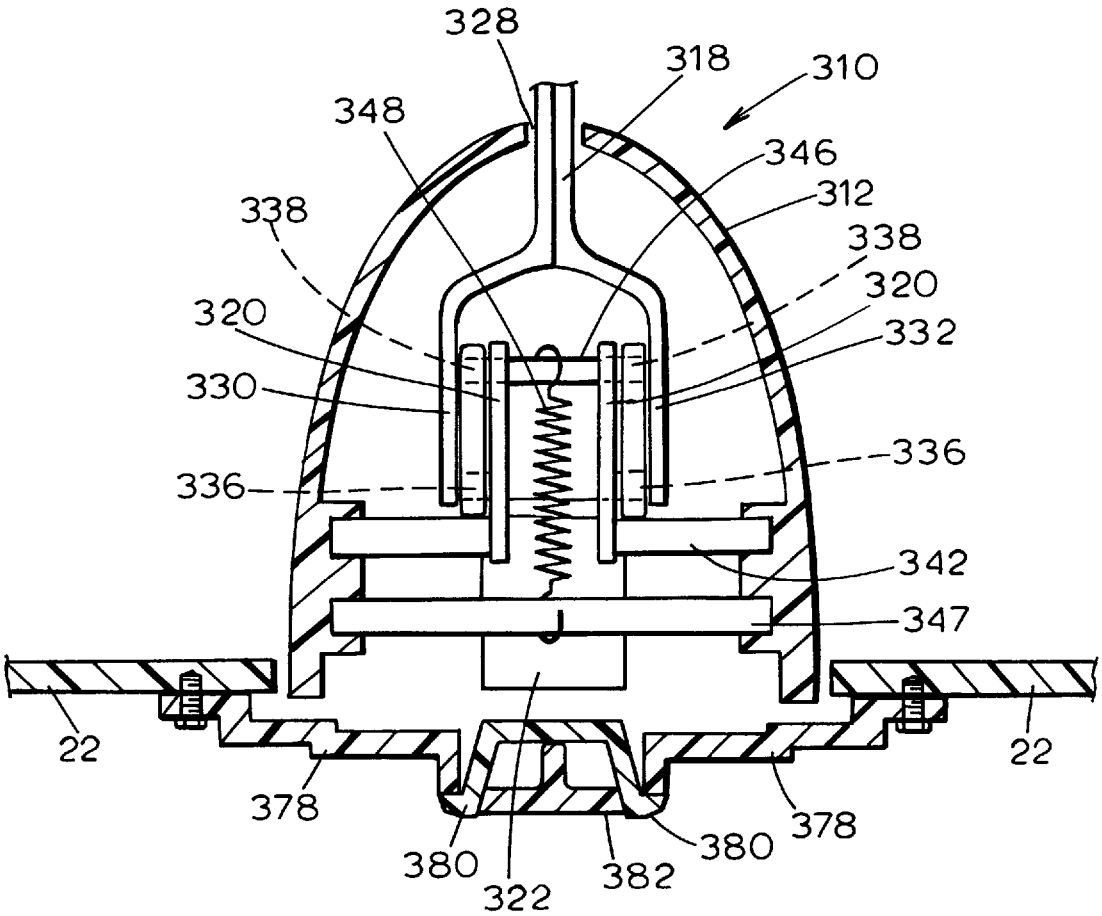
FIG. 20 is a cross-sectional view of the mechanism of taken along line 20—20 in FIG. 18.

The yoke shaft 318 is preferably split near its lower end as illustrated in FIG. 20, into a first arm 330 and a second arm 332. The yoke shaft 318 is pivoted at the lower ends of its first arm 330 and its second arm 332 to the yoke 320 via a pivot 336 on each arm. Disposed slightly above the pivot 336 is a yoke arm stop which is disposed in an arcuate opening 340 in the yoke 320. In this manner, the yoke shaft 318 will normally be in the positions illustrated in FIGS. 17 and 19 and thus move to a different position by an external force such as the counterweight housing 314 engaging a fixed surface on the frame 22. The yoke 320 itself is split as illustrated in FIG. 20 and each half is pivotably connected to the pawl housing 312 on a single transverse rod 342. The yoke 320 includes an upper post 346 which laterally extends between the yoke halves. Extending between the post 346 and a transverse pawl housing bar 347 is a tension spring 348 that biases the yoke 320 so that the top of the yoke 320 tends toward the bottom of the pawl housing 312. Stops 350 fixed to the inside of the pawl housing 312 prevent the yoke 320 from extending beyond the positions illustrated in FIGS. 17 and 19. In this manner, with no external forces being applied to the ratcheted mechanism 310, the counterweight housing 314 and the yoke 320 will be in the positions illustrated in FIGS. 17 and 19. In these positions, the yoke 320 will engage one or the other of the first pawl 322 or the second pawl 324 to keep the engaged pawl up on the pawl housing 312.

Figure 17:
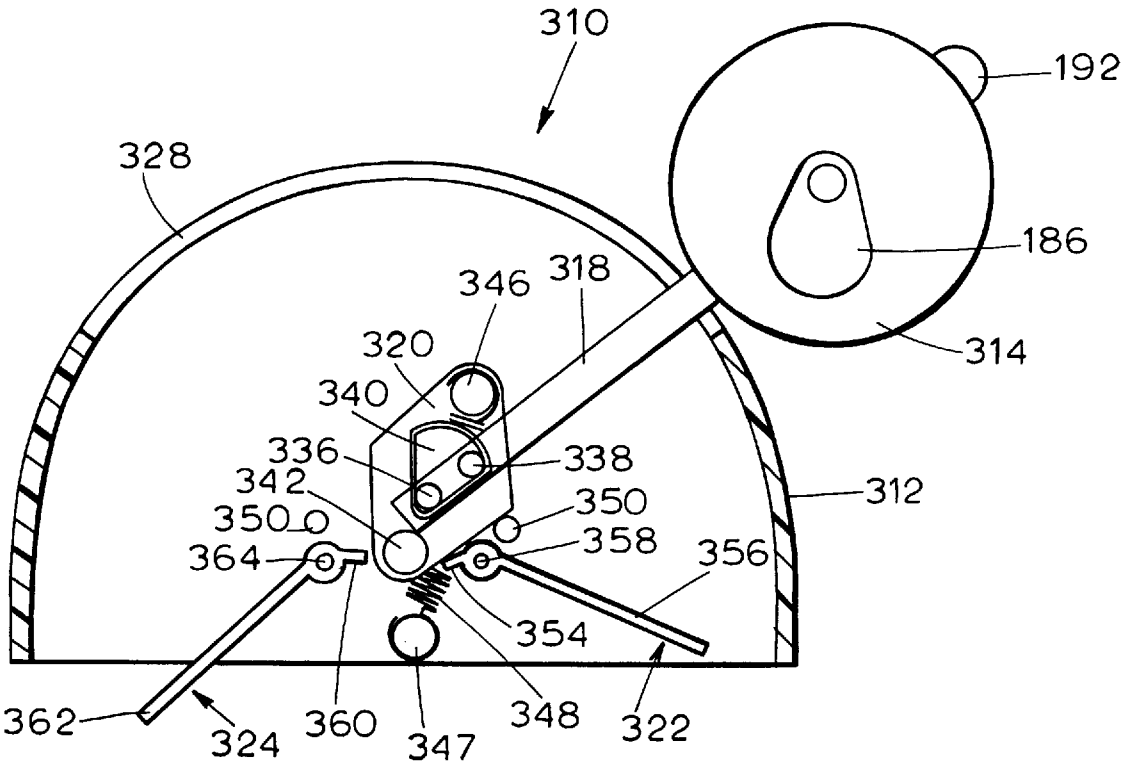
FIG. 17 is a side cross-sectional view of a mechanism for being ratcheted along a raceway in accordance with the present invention.

As illustrated in FIG. 17, the yoke 320 is bearing on a short end 354 of the first pawl 322 which rotates freely about a pivot point 358 to lift a long end 356 of the first pawl 322 up into the pawl housing 312. As illustrated in FIG. 19 the yoke 320 has been pivoted about pivot point 342 to an opposite position bearing on a short end 360 of the second pawl 324 to rotate the second pawl 324 around its pivot 364 and raise a long end 362 of the pawl 324 upward in the pawl housing 312.

When the yoke 320 is bearing on the short end 354 of the first pawl 322 the yoke 320 does not engage the second pawl 324. Conversely, when the yoke 320 is bearing on the short end 360 of the second pawl 324, the yoke 320 does not engage the first pawl 322. In this manner, the yoke 320 will engage one or the other pawl and be free from engagement of the remaining pawl so that the remaining pawl can extend downwardly out of the pawl housing 312 to engage the reciprocating ratchet track 130, as described above to propel the pawl housing 312 through the game 20 race tracks 30.

Figure 18:
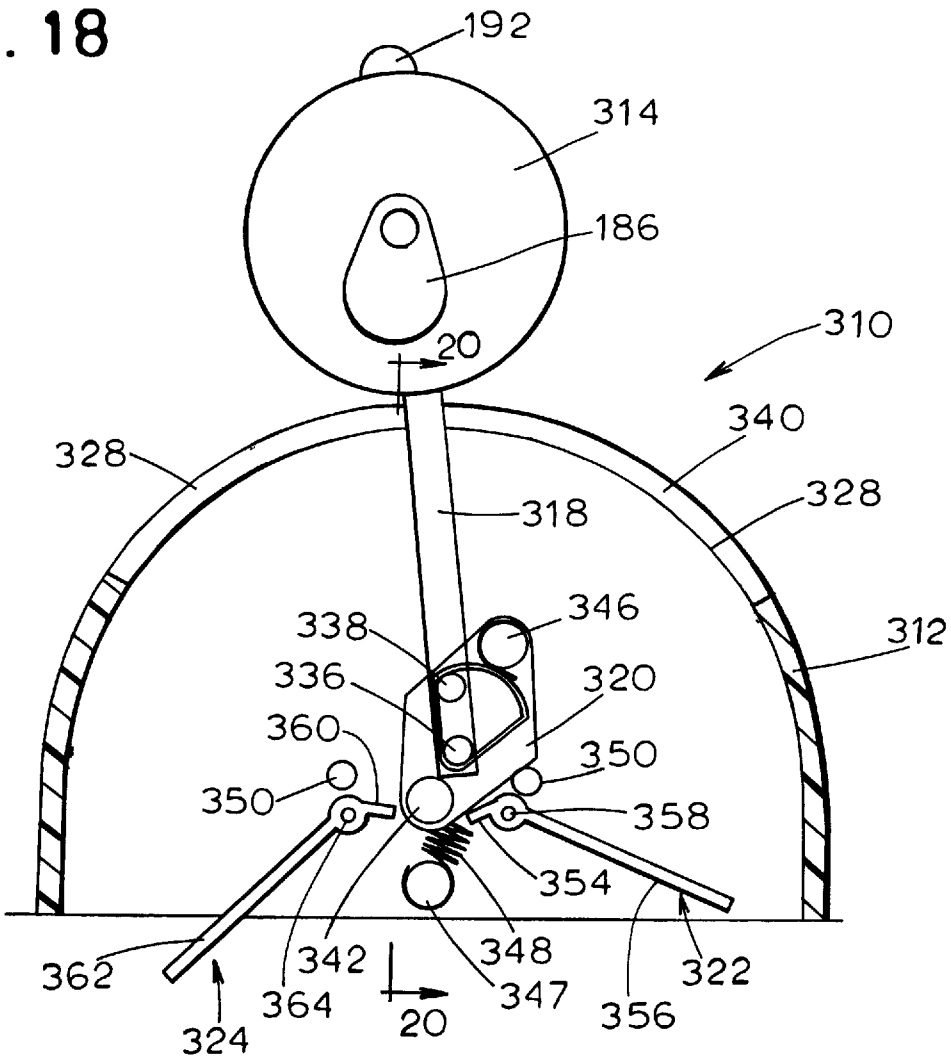
FIG. 18 is the mechanism of FIG. 17 in a second position.

The mechanism 310 will change directions when it nears the end of the reciprocating ratchet track 130 where the counterweight housing 314 engages an upwardly curved surface (not illustrated) which forces the pawl housing 312 to pivot on the yoke shaft 318, as illustrated in FIG. 18. As the counterweight housing 314 pivots in the opposite direction, the yoke shaft 318 will pivot about pivot 336 until the yoke arm stop 338 engages the opposite end of the arcute opening 340, as illustrated in FIG. 18. From this point the pawl housing 312 will continue to pivot and act on the yoke 320 to pivot the yoke 320 about its pivot point 342. As the yoke 320 moves from the position illustrated in FIGS. 17 and 18 toward the position illustrated in FIG. 19, the yoke 320 will disengage the first pawl 322 and engage the second pawl 324 which in turn disengages the second pawl 324 from the ratchet track 130 and engages the first pawl 322 with the ratchet track 130 so that the pawl housing 312 will move in the opposite direction in response to the ratchet track 130 reciprocating.

Also illustrated in FIG. 20 is a portion of the frame 22 with a bottom plate 378 screwed thereto. A reciprocating ratchet track 380 is snapped into a slot in the bottom plate and maintained in the illustrated position by retainer 382 which permits reciprocating movement of the ratchet track 380, but maintains the ratchet track in close contact with the frame 22 and mechanism 310.

The foregoing detailed description of drawings is meant for clearness of understanding only, and no unnecessary limitations therefrom should be read into the following claims.

We claim:

1. A game comprising:

a frame;

a bowl formed in said frame;

a pair of tracks formed in said frame, each of said tracks extending into said bowl;

a first receptacle associated with one of said tracks;

a second receptacle associated with another of said tracks;

at least three spherical game pieces adapted to be disposed within said bowl and movable along said tracks;

a pair of movable members, each of said movable members being adapted to move along a respective one of said tracks;

a pair of ratcheting mechanisms, each of said ratcheting mechanisms being operatively coupled to a respective one of said movable members, said ratcheting mechanisms being adapted to cause said movable members to be moved along said tracks in a first direction, to automatically change from said first direction to a second direction along said tracks, and then to automatically change back to said first direction along said tracks;

a pair of actuators, each of said actuators being operatively coupled to a respective one of said ratcheting mechanisms so that actuation of said actuators causes said ratcheting mechanisms to move said movable members along said tracks, so that repeated actuation of one of said actuators is adapted to cause one of said movable members to enter said bowl to engage one of said spherical game pieces in said bowl, to push said one spherical game piece along one of said tracks and out of said bowl until said one spherical game piece is deposited in one of said receptacles, and to automatically change direction so that said one movable member reenters said bowl to engage another of said spherical game pieces.

2. A game as defined in claim 1 wherein each of said movable members has a housing with a shape in the form of an animal.

3. A game as defined in claim 1 wherein each of said movable members has a housing with a shape in the form of a puppy.

4. A game as defined in claim 1 wherein each of said actuators comprises a knob that is adapted to be repeatedly depressed.

5. A game as defined in claim 1 wherein each of said actuators comprises:

a knob that is adapted to be repeatedly depressed; and a plunger assembly operatively coupled to said knob and said ratcheting mechanism.

6. A game as defined in claim 1, additionally comprising:

a first pivotal gate associated with one of said tracks; and a second pivotal gate associated with another of said tracks, each of said pivotal gates being adapted to allow said movable members to pass through.

7. A game comprising:

a frame;

a retaining area formed in said frame;

a pair of tracks formed in said frame, each of said tracks extending into said retaining area;

a first receptacle associated with one of said tracks;

a second receptacle associated with another of said tracks;

at least three game pieces adapted to be disposed within said retaining area and movable along said tracks;

a pair of movable members, each of said movable members being adapted to move along a respective one of said tracks;

a pair of ratcheting mechanisms, each of said ratcheting mechanisms being operatively coupled to a respective one of said movable members, said ratcheting mechanisms being adapted to cause said movable members to be moved along said tracks in a first direction, to automatically change from said first direction to a second direction along said tracks, and then to automatically change back to said first direction along said tracks;

a pair of actuators, each of said actuators being operatively coupled to a respective one of said ratcheting mechanisms so that actuation of said actuators causes said ratcheting mechanisms to move said movable members along said tracks, so that repeated actuation of one of said actuators is adapted to cause one of said movable members to enter said retaining area to engage one of said game pieces in said retaining area, to push said one game piece along one of said tracks and out of said retaining area until said one game piece is deposited in one of said receptacles, and to automatically change direction so that said one movable member reenters said retaining area to engage another of said game pieces.

8. A game as defined in claim 7 wherein said retaining area comprises a bowl.

9. A game as defined in claim 7 wherein each of said movable members has a housing with a shape in the form of an animal.

10. A game as defined in claim 7 wherein each of said movable members has a housing with a shape in the form of a puppy.

11. A game as defined in claim 7 wherein each of said actuators comprises a knob that is adapted to be repeatedly depressed.

12. A game as defined in claim 7 wherein each of said actuators comprises:

a knob that is adapted to be repeatedly depressed; and a plunger assembly operatively coupled to said knob and said ratcheting mechanism.

13. A game as defined in claim 7, additionally comprising:

a first pivotal gate associated with one of said tracks; and a second pivotal gate associated with another of said tracks, each of said pivotal gates being adapted to allow said movable members to pass through.

14. A game comprising:

a frame;

a retaining area formed in said frame;

a track formed in said frame, said track extending into said retaining area;

a receptacle associated with said track;

a plurality of game pieces adapted to be disposed within said retaining area and movable along said track;

a movable member adapted to move along said track;

a mechanism operatively coupled to cause movement of said movable member along said track, so that said movable member enters said retaining area to engage one of said game pieces in said retaining area, to push said one game piece along said track and out of said retaining area until said one game piece is deposited in said receptacle, and to automatically change direction so that said one movable member reenters said retaining area to engage another of said game pieces.

15. A game as defined in claim 14 wherein said retaining area comprises a bowl.

16. A game as defined in claim 14 wherein said movable member has a housing with a shape in the form of an animal.

17. A game as defined in claim 14 wherein said movable member has a housing with a shape in the form of a puppy.

18. A game as defined in claim 14 wherein said mechanism comprises:

an actuator that is adapted to be repeatedly depressed;

a ratcheting mechanism coupled to said movable member, said ratcheting mechanism being adapted to cause said movable member to be moved along said track in a first direction, to automatically change from said first direction to a second direction along said track, and then to automatically change back to said first direction along said track; and a plunger assembly operatively coupled to said knob and said ratcheting mechanism.

19. A game as defined in claim 14, additionally comprising:

a first pivotal gate associated with one of said tracks; and a second pivotal gate associated with another of said tracks, each of said pivotal gates being adapted to allow said movable members to pass through.

* * * * *